US008020981B2

(12) United States Patent
Sakurai et al.

(10) Patent No.: US 8,020,981 B2
(45) Date of Patent: Sep. 20, 2011

(54) INKJET RECORDING APPARATUS AND AIR REMOVAL METHOD THEREFOR

(75) Inventors: Hisaki Sakurai, Aichi-ken (JP); Takamasa Usui, Ogaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1041 days.

(21) Appl. No.: 11/825,205

(22) Filed: Jul. 5, 2007

(65) Prior Publication Data

US 2008/0007605 A1 Jan. 10, 2008

(30) Foreign Application Priority Data

Jul. 5, 2006 (JP) ..... 2006-185293

(51) Int. Cl.
*B41J 2/19* (2006.01)

(52) U.S. Cl. ..... 347/92; 347/5; 347/6; 347/7

(58) Field of Classification Search ..... 347/1–100
See application file for complete search history.

(56) References Cited

U.S. PATENT DOCUMENTS

| | | | | |
|---|---|---|---|---|
| 6,199,976 | B1 | 3/2001 | Sasada | |
| 6,517,189 | B2 * | 2/2003 | Ogawa et al. | 347/35 |
| 6,626,516 | B2 | 9/2003 | Tsukuda | |
| 6,796,627 | B2 * | 9/2004 | Kimura et al. | 347/7 |
| 7,399,075 | B2 * | 7/2008 | Nomura et al. | 347/89 |
| 2002/0041305 | A1 | 4/2002 | Tsukuda | |
| 2003/0007045 | A1 | 1/2003 | Yoshida et al. | |
| 2003/0007047 | A1 | 1/2003 | Otsuka et al. | |
| 2003/0011668 | A1 | 1/2003 | Yoshida | |
| 2003/0160848 | A1 | 8/2003 | Taniguchi et al. | |
| 2004/0090501 | A1 | 5/2004 | Yoshida et al. | |
| 2004/0160496 | A1 | 8/2004 | Tsurui et al. | |
| 2005/0253909 | A1 | 11/2005 | Usui | |
| 2006/0001715 | A1 | 1/2006 | Umeda et al. | |
| 2006/0139418 | A1 | 6/2006 | Udagawa | |
| 2006/0146107 | A1 | 7/2006 | Tsurui et al. | |

FOREIGN PATENT DOCUMENTS

| | | |
|---|---|---|
| JP | 2000/246917 | 9/2000 |
| JP | 2002/166570 | 6/2002 |
| JP | 2002-166570 | 6/2002 |
| JP | 2002-200773 | 7/2002 |
| JP | 2002-370374 | 12/2002 |
| JP | 2003/246077 | 9/2003 |
| JP | 2004-255861 | 9/2004 |

(Continued)

*Primary Examiner* — Ryan Lepisto
*Assistant Examiner* — Guy Anderson
(74) *Attorney, Agent, or Firm* — Frommer Lawrence & Haug LLP

(57) ABSTRACT

There is provides an inkjet recording apparatus comprising: an inkjet head held in a head holder; and an ink tank mounted on the head holder. The ink tank has an ink chamber, a path for communicating the chamber with atmosphere, and an exit valve to open and close the path. The apparatus further comprises: an ink cartridge arranged below the ink tank for supplying the ink to the ink chamber through a channel; an operating member for opening and closing the exit valve; a ink transfer device; and a controller. The controller performs controls of causing the operating member to open the exit valve such that an atmosphere pressure affects an inside of the ink chamber, and such that the ink both in the chamber and in the channel returns to the ink cartridge through the channel; and causing the device to fill the chamber.

14 Claims, 3 Drawing Sheets

FOREIGN PATENT DOCUMENTS

| | | |
|---|---|---|
| JP | 2005/007855 | 1/2005 |
| JP | 2005/288929 | 10/2005 |
| JP | 2005/324358 | 11/2005 |
| JP | 2006/082285 | 3/2006 |
| JP | 2006/095868 | 4/2006 |
| JP | 2006-103056 | 4/2006 |
| JP | 2006-159790 | 6/2006 |

* cited by examiner

INKJET RECORDING APPARATUS AND AIR REMOVAL METHOD THEREFOR

CROSS-REFERENCE OF RELATED APPLICATION

This non-provisional application claims priority under 35 U.S.C. §119(a) on Patent Application No. 2006-185293 in Japan on Jul. 5, 2006, the entire contents of which are hereby incorporated by reference.

BACKGROUND

1. Technical Field

The present invention relates to an inkjet recording apparatus and an air removal method therefor.

2. Description of Related Art

A known inkjet recording apparatus (for example, see Japanese Patent Application Laid-Open No. 2004-255861, FIG. 9) includes a head holder which retains an inkjet head and is supported relatively movable with respect to a recording medium. An ink tank is mounted on the inkjet head for supplying ink. An ink cartridge which supplies the ink to the ink tank through a tube is arranged below the ink tank and outside the head holder. In the recording apparatus having the above configuration, the ink is supplied from the ink cartridge to the ink tank through the tube. The ink is further supplied from the ink tank to the inkjet head and, in the meantime, air included in the ink is separated. The air remains in the ink tank. An air vent passage provided in an upper portion of the ink tank includes air vent valve means, the air remaining in the ink tank is exhausted to the outside by opening the air vent valve means. As is well known, in a nozzle of the inkjet head, a restoring process is performed while a suction cap is brought into close contact with the inkjet head.

SUMMARY

In the inkjet recording apparatus, suction means connected to the air vent passage can remove the air remaining in the ink tank for a shorter time. However, in the case where the air existing in an ink supply channel system such as a tube located on an upstream side of the ink tank is also removed, because a location of the air cannot be specified, it is necessary that a suction amount performed by the suction means become larger compared with a suction amount in removing only the air remaining in the ink tank.

Thus, when the suction amount performed by the suction means is set larger, the air existing in the ink supply system can surely be exhausted along with the air remaining in the ink tank. However, a larger amount of ink which is sucked and not used in the recording becomes wasted.

On the contrary, there has been proposed a method in which the air is removed by utilizing difference in elevation between a sub-tank (ink tank) and a main tank (for example, see Japanese Patent Application Laid-Open No. 2002-166570, FIG. 1). The sub-tank temporarily retains the ink discharged from the inkjet head, and the main tank retains the ink supplied to the sub-tank. The ink in the sub-tank is returned to the main tank side (however, the ink is caused to remain in the tube connecting the sub-tank and the main tank by a meniscus force of a filter on the main tank side). Then, the ink is pressure-transferred from the main tank side to the sub-tank to fill the sub-tank with the ink. Thus, the air remaining in the sub-tank can be removed.

In the technique disclosed in Japanese Patent Application Laid-Open No. 2002-166570, the sub-tank is temporarily emptied and the ink remains in the tube connecting the sub-tank and the main tank. In the case where the air remains in the tube, sometimes the ink whose viscosity is increased is generated due to volatilization of solvent into the air from the ink. Therefore, when the sub-tank is filled with the ink again, the air and ink whose viscosity is increased in the tube flow possibly into the sub-tank again. In particular, an ink supply channel such as the tube connecting the sub-tank and the main tank is long and thin, and the ink supply channel is made of a material having a low air-barrier property in order to maintain flexibility. Therefore, because the ink in the ink supply channel is in contact with the external air with a large area, the ink easily includes the penetrating air and/or the viscosity of the ink is easily increased. In the case where the ink flows into the sub-tank again, the air and the ink whose viscosity is increased can disturb the ink discharged from the inkjet head during the recording.

An object is to provide an inkjet recording apparatus with a simple structure in which air existing in the ink supply system can be removed by utilizing difference in elevation between the ink tank and the ink cartridge, and an air removal method thereof.

There is provided an inkjet recording apparatus according to an aspect, comprising: an inkjet head for discharging ink to a recording medium; a head holder relatively movable with respect to the recording medium, the head holder for holding the inkjet head; an ink tank mounted on the head holder and having an ink chamber for reserving the ink, a communicating path for communicating the ink chamber with atmosphere, and an exit valve to open and close the communicating path with respect to the atmosphere, the ink tank for supplying the ink to the inkjet head; an ink cartridge arranged below the ink tank for supplying the ink to the ink chamber through an ink supply channel; an operating member for opening and closing the exit valve; a transfer device for applying a pressure to the ink to transfer the ink from the ink cartridge to the ink chamber; and a controller for performing controls of causing the operating member to open the exit valve such that an atmosphere pressure affects an inside of the ink chamber, and such that the ink in the ink chamber and the ink in the ink supply channel return to the ink cartridge through the ink supply channel; and causing the transfer device to fill the ink chamber with the ink from the ink cartridge through the ink supply channel.

DETAILED DESCRIPTION

An embodiment of the invention will be described below with reference to the drawings. Each suffix of B, Y, M, and C added to the numeral indicates that the numeral is used for each of black, yellow, magenta, and cyan inks.

Figure 1:
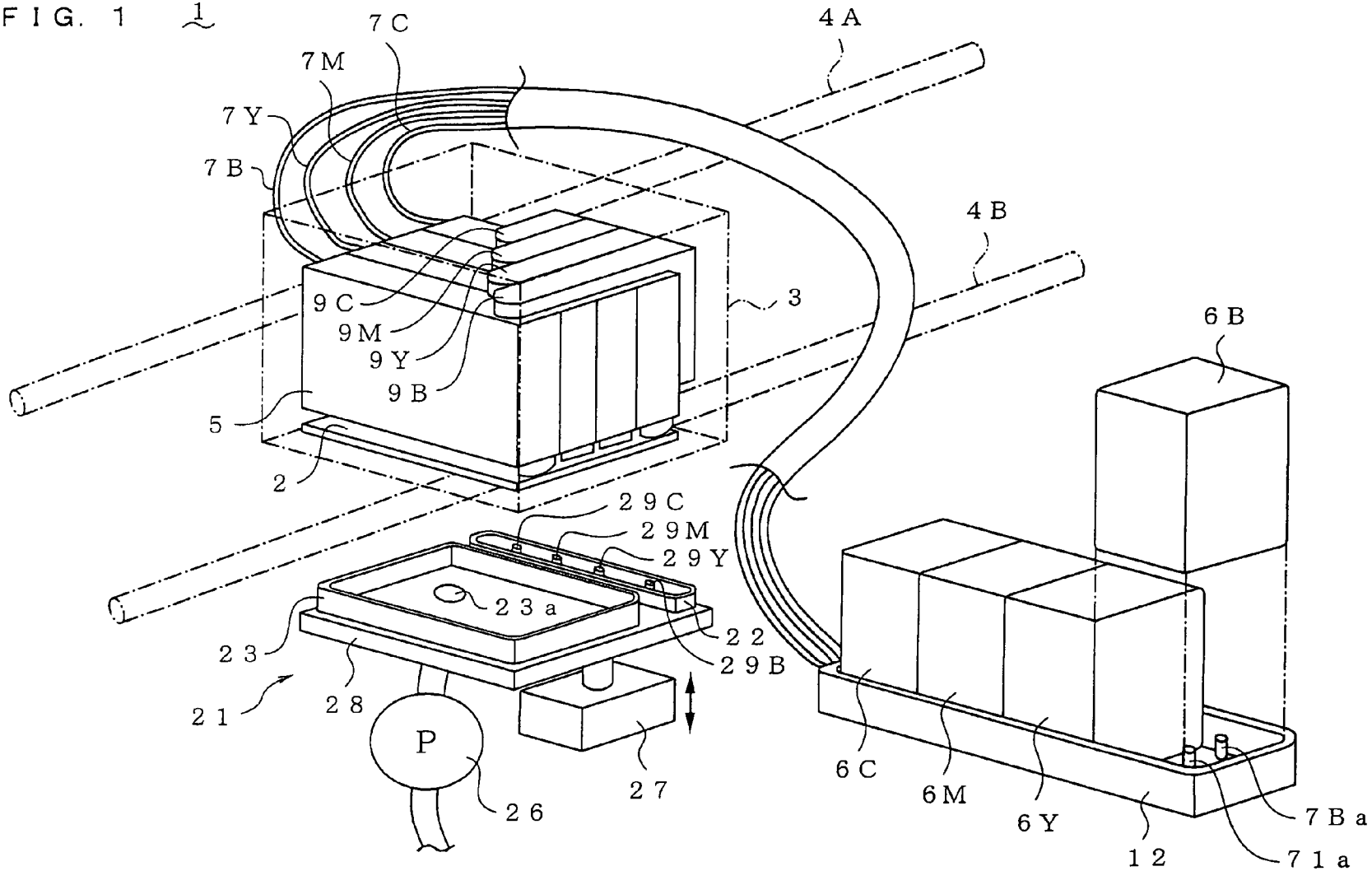
FIG. 1 is a perspective view showing an entire configuration of an inkjet recording apparatus according to the invention.
Figures 2A, 2B:
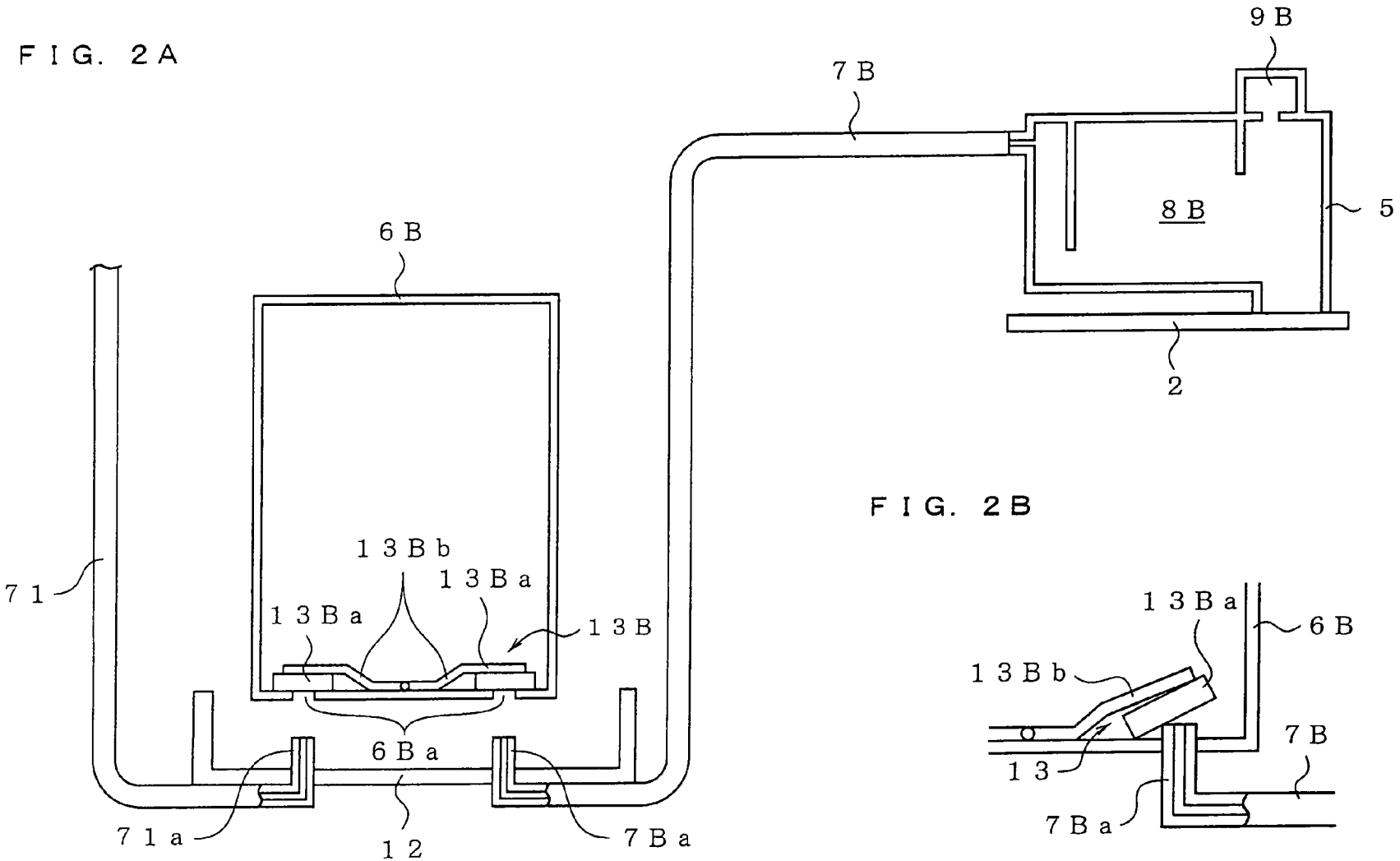
FIG. 2A is an explanatory view showing a positional relationship between an ink tank and an ink cartridge.
FIG. 2B is an explanatory view showing a connection state between the ink cartridge and an ink supply tube.

As shown in FIGS. 1 and 2A, an inkjet recording apparatus 1 includes an inkjet head 2. The inkjet head 2 is retained by a head holder 3, and the head holder 3 is supported while being relatively movable to a recording medium. The inkjet head 2 has a group of nozzles which discharge plural kinds of inks (see 2B, 2Y, 2M, and 2C in FIG. 3). Specifically, the head holder 3 is supported while being reciprocally movable along guide rails 4A and 4B extended in a direction orthogonal to a recording-medium feed direction by drive means. An ink tank 5 is mounted on the head holder 3 to supply the ink to the inkjet head 2.

The ink tank 5 includes ink reservoir chambers 8B, 8Y, 8M, and 8C (see FIG. 3) and air vent passages 9B, 9Y, 9M, and 9C. The plural kinds of inks are reserved in the ink reservoir chambers 8B, 8Y, 8M, and 8C respectively. The air vent passages 9B, 9Y, 9M, and 9C communicate upper spaces of the ink reservoir chambers 8B, 8Y, 8M, and 8C and atmosphere respectively. Ink cartridges 6B, 6Y, 6M, and 6C are arranged outside the head holder 3 and below the ink tank 5. The inks are supplied to the ink reservoir chambers 8B to 8C from the ink cartridges 6B, 6Y, 6M, and 6C through ink supply tubes 7B, 7Y, 7M, and 7C (ink supply channels).

FIGS. 2A and 2B show an upstream end of the ink supply tube 7B of the black ink. Each of the upstream ends in the ink supply tubes 7B to 7C is formed as a cylindrical connection portion 7Ba. The connection portion 7Ba attached to at a predetermined position in a bottom of a dish-shape cartridge holder 12 such that a central axis line of the connection portion 7Ba is extended in a vertical direction. A connection portion 71*a* of an atmospheric communicating tube 71 is attached to the bottom of the cartridge holder 12 in parallel with the connection portion 7Ba. The ink cartridge 6B is lowered toward the cartridge holder 12, which allows the ink cartridge 6B to be detachably attached to the cartridge holder 12. The connection enables the ink to be supplied to the ink reservoir chamber 8B of the ink tank 5. Specifically, in the bottom of the ink cartridge 6B, there are formed holes 6Ba for detachably connecting the connection portions 7Ba and 71*a* respectively. An on-off valve 13B which is opened by connection is provided in the holes 6Ba. The on-off valve 13B includes valve bodies 13Ba and a leaf spring 13Bb (shared by the two valve bodies 13Ba). The valve bodies 13Ba openably close the holes 6Ba and 6Ba, and the leaf spring 13Bb biases the valve bodies 13Ba toward the direction in which the hole 6Ba is closed. When the ink is supplied from the ink cartridge 6B to the ink supply tube 7B, the atmosphere is introduced from the atmospheric communicating tube 71 to the ink cartridge 6B to substantially maintain the inside of the ink cartridge 6B at an atmospheric pressure.

The ink supply tubes 7B to 7C are openings of the ink reservoir chambers 8B and 8C respectively. Each opening end has the substantially same inner diameter as that of the ink supply tube. The inner diameter is maintained from the opening end to the inside of each of the ink supply tubes 7B to 7C. Therefore, surface tension is prevented from forming a meniscus of the ink at the opening end against difference in water head between the opening end and each of the ink cartridges 6B to 6C. Additionally, capillarity is prevented from retaining the ink in each of the ink supply tubes 7B to 7C irrespective of the atmospheric pressure in the inside of each of the ink reservoir chambers 8B to 8C.

Figure 3:
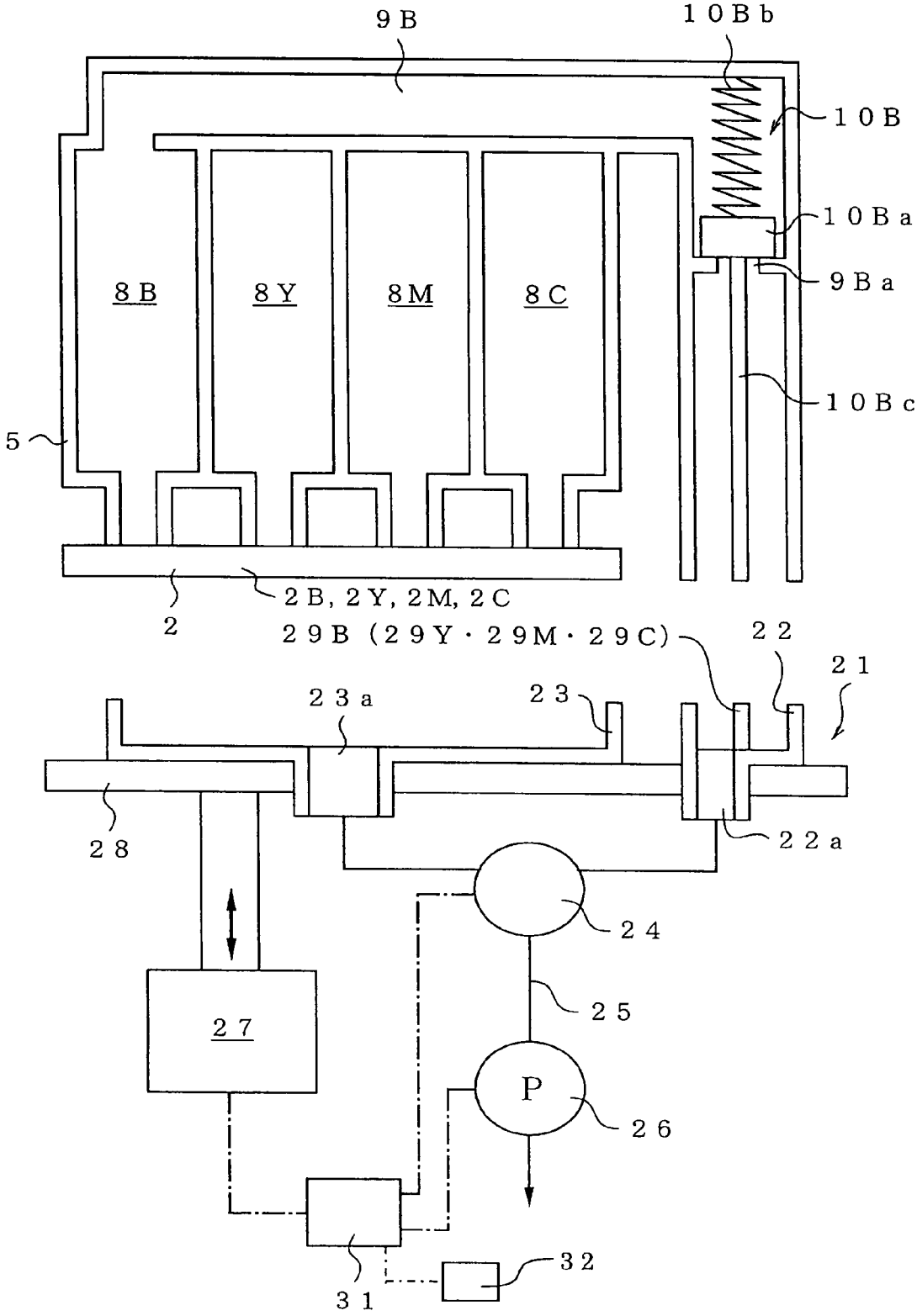
FIG. 3 is an explanatory view showing a relationship between air vent valve means and suction means.

FIG. 3 shows the air vent passage 9B of the black ink. An air vent valve means 10B is provided in the air vent passage 9B to open and close the air vent passage 9B. The air vent valve means 10B is configured to be switchable between an open state where the ink reservoir chamber 8B is communicated with the atmosphere and a close state where the ink reservoir chamber 8B is blocked from the atmosphere. As shown in FIG. 3, the air vent valve means 10B includes an air vent valve 10Ba which openably closes an air vent port 9Ba provided near an opening on the atmospheric side of the air vent passage 9B. The air vent valve means 10B also includes a spring member 10Bb which always biases the air vent valve 10Ba toward the direction in which the air vent port 9Ba is closed. The air vent valve 10Ba includes an extended shaft portion 10Bc in a surface opposite to the spring member 10Bb. The extended shaft portion 10Bc is operated by a later-mentioned rod member (operating member) against a spring force of the spring member 10Bb to raise the air vent valve 10Ba, which opens the air vent valve means 10B (air vent port 9Ba). A central axis of the ink discharge nozzle in the inkjet head 2 is substantially parallel to a longitudinal axis of the extended shaft portion 10Bc. Open rear ends of the ink discharge nozzles in the inkjet head 2 are opened at the substantially same level near the opening end on the atmosphere of each of the air vent passages 9B to 9C in a lower surface of the head holder 3.

As shown in FIGS. 1 and 3, suction means 21 is provided at a predetermined standby position which is not involved in the recording of the recording medium on a movement path of the head holder 3, and the recording medium faces the lower surface of the head holder 3. The suction means 21 reduces a pressure in each of the ink reservoir chambers 8B to 8C.

The suction means 21 includes an air vent cap 22 which is provided at a stationary position outside the head holder 3 to be able to be separated from and brought into contact with the opening end on the atmospheric side of each of the air vent passages 9B to 9C. The suction means 21 also includes a suction cap 23 which is provided at the stationary position outside the head holder 3 to be able to be separated from and brought into contact with the ink discharge nozzle of the inkjet head 2. The air vent cap 22 and the suction cap 23 are provided close to each other. Connection opening portions 22*a* and 23*a* of the air vent cap 22 and suction cap 23 are connected to a suction pump 26 through a suction passage 25 having a solenoid switch valve 24. The switch valve 24 selectively connects the air vent cap 22 and the suction cap 23 to the suction pump 26 though the suction passage 25.

The air vent cap 22 and the suction cap 23 are attached to a movable plate 28 which is supported while elevated by an elevating device 27. Rod members 29B, 29Y, 29M, and 29C are vertically projected in the air vent cap 22 corresponding to the longitudinal axes of the extended shaft portions 10Bc to 10Cc of the air vent valve means respectively. The air vent valves 10Ba to 10Ca are elevated to open the air vent ports 9Ba to 9Ca by elevating the rod members 29B to 29C. That is, the air vent valve means 10B to 10C are opened by elevating the rod members 29B to 29C, or the air vent valve means 10B to 10C are opened and closed by the opening and closing operations of the operating members (rod members) 29B to 29C.

Control means 31 formed by, e.g., microcomputer controls the solenoid switch valve 24, the suction pump 26, and the elevating device. A timer 32 is connected to the control means 31 to measure a time point at which the control is performed, a time necessary to the control, and an elapses time from one piece of control to another piece of control. The control means 31 can determine timing of the following control based on a timer signal from the timer 32.

Usually, in the state where the recording operation can be performed, the inks in the ink reservoir chambers 8B to 8C of the ink tank are communicated with the inks in the ink cartridges 6B to 6C through the tubes 7B to 7C. The air vent valves (only the air vent valve 10Ba is shown) block the ink reservoir chambers 8B to 8C from the atmosphere, and the ink reservoir chambers 8B to 8C are in the sealed state. An opening-end surface of the ink discharge nozzle in the inkjet head 2 is parallel to the lower surface of the head holder 3. The opening-end surface of the ink discharge nozzle is located above the ink cartridges 6B to 6C in a gravity direction. The inks in the ink reservoir chambers 8B to 8C are located above the opening-end surface of the ink discharge nozzle. Therefore, a negative pressure is applied to the inks in the ink reservoir chambers 8B to 8C due to the difference in water head between the inks in the ink reservoir chambers 8B to 8C and the inks in the ink cartridges 6B to 6C respectively. In this state, as is well known, the concave meniscus of the ink is formed in the ink discharge nozzle of the inkjet head 2. The ink is discharged in the form of a droplet from the ink discharge nozzle by the operation of the inkjet head 2.

During the recording operation, when the ink is introduced to each of the ink reservoir chambers 8B to 8C, the air included in the ink emerges and separated from the ink, and the air remains in each of the ink reservoir chambers 8B to 8C. In the case where the air remaining in each of the ink reservoir chambers 8B to 8C is removed, the control means 31 moves the head holder 3 to the position where the head holder 3 faces the suction means 21. Then, the control means 31 drives the elevating device 27 to raise the air vent cap 22 and the suction cap 23, and whereby the opening end on the atmospheric side of each of the air vent passages 9B to 9C and the nozzle surface of the inkjet head 2 are covered with the air vent cap 22 and the suction cap 23 respectively. At this point, the rod members 29B to 29C push up the extended shaft portions of the air vent valves (only the air vent valve 10Ba is shown), which opens the air vent valves. Then, the control means 31 switches the switch valve 24 to the state where the air vent cap 22 and the suction pump 26 are communicated with each other. The control means 31 drives the suction pump 26 for a predetermined time to exhaust the air remaining in each of the ink reservoir chambers 8B to 8C.

On the contrary, in the state where the air vent cap 22 and the suction cap 23 are in close contact with the opening end on the atmospheric side of each of the air vent passages 9B to 9C and the nozzle surface of the inkjet head 2, the control means 31 may switch the switch valve 24 to the state where the suction cap 23 and the suction pump 26 are communicated with each other (air vent cap 22 is blocked from the suction pump 26). In this case, the control means 31 drives the suction pump 26 for a predetermined time to exhaust the air in the inkjet head and the ink whose viscosity is increased. The exhaust operation may be performed prior to the exhaust operation performed in the state where the air vent cap 22 and the suction pump 26 are communicated with each other, or the exhaust operation may be performed subsequent to the exhaust operation performed in the state where the air vent cap 22 and the suction pump 26 are communicated with each other.

In the case where the air of the whole ink supply system including the ink supply tubes 7B to 7C and the ink tank 8 is removed, the control means 31 moves the head holder 3 to the position where the head holder 3 faces the suction means 21. Then, the control means 31 drives the elevating device 27 to raise the rod members 29B to 29C, and thereby opening the air vent valve. The air vent cap 22 is in close contact with the opening end on the atmospheric side of each of the air vent passages 9B to 9C. The control means 31 switches the switch valve 24 to the state where the air vent cap 22 and the suction pump 26 are communicated with each other. In this state of things, as long as the control means 31 does not drive the suction pump 26, the ink reservoir chambers 8B to 8C are communicated with the atmosphere through the air vent passages 9B to 9C, the air vent cap 22, the switch valve 24, and the suction pump 26 respectively. Therefore, the inside of each of the ink reservoir chambers 8B to 8C becomes the atmospheric pressure. Because the ink cartridges 6B to 6C are arranged below the ink tank 5, the inks in the ink reservoir chambers 8B to 8C and ink supply tubes 7B to 7C return to the ink cartridges 6B to 6C through the ink supply tubes 7B to 7C respectively. The nozzle surface of the inkjet head 2 is covered with the suction cap 23.

Now, the air vent cap 22 is communicated with the suction pump 26. Then, the control means 31 drives the suction pump 26 to reduce the pressure of the inside of each of the ink reservoir chambers 8B to 8C from each of the air vent passages 9B to 9C through the air vent cap 22 (obviously, the control means 31 reduces the pressure not more than a pressure corresponding to the difference in elevation between the ink cartridge and the ink reservoir chamber, namely the control means 31 applies the negative pressure). Therefore, the ink reservoir chambers 8B to 8C are filled with the inks from the ink cartridges 6B to 6C through the ink supply tubes 7B to 7C respectively. The control means 31 drives the elevating device 27 to lower the air vent cap 22, the suction cap 23, and the rod members 29B to 29C, and thereby closing the air vent valves 10B to 10C. In this state of things, the inks in the ink reservoir chambers 8B to 8C are communicated with the inks in the ink cartridges 6B to 6C through the ink supply tubes 7B to 7C respectively. Therefore, the negative pressure is applied to the inks in the ink reservoir chambers 8B to 8C due to the difference in water head between the inks in the ink reservoir chambers 8B to 8C and the inks in the ink cartridges 6B to 6C respectively. This enables the concave ink meniscus to be formed in the ink discharge nozzle of the inkjet head 2 to make the recording apparatus recordable.

In place of the air vent cap 22, the suction cap 23 may be communicated with the suction pump 26. In this case, the pressure in each of the ink reservoir chambers 8B to 8C is reduced through the ink discharge nozzle and the suction cap 23, so that the ink reservoir chambers 8B to 8C can be filled with the inks from the ink cartridges 6B to 6C through the ink supply tubes 7B to 7C respectively.

Thus, the inks in the ink reservoir chambers 8B to 8C and the inks in the ink supply tubes 7B to 7C are returned to the ink cartridges 6B to 6C respectively, whereby not only the air in the ink reservoir chambers 8B to 8C but also the air and the ink whose viscosity is increased remaining in the tubes 7B to 7C are restored into the ink cartridges 6B to 6C. Then, the ink reservoir chambers 8B to 8C are filled with the inks from the ink cartridges 6B to 6C respectively, thereby allowing the whole ink supply system including the ink supply tubes 7B to 7C and the ink reservoir chambers 8B to 8C to be filled with substantially new ink which do not include air and ink whose viscosity is increased.

In addition to the above embodiment, following modifications can be made by way of example.

(i) The suction means 21, according to the above embodiment, includes both the air vent cap 22 and the suction cap 23, while it is always not necessary that the suction means 21 include the air vent cap 22 and the suction cap 23. The suction means 21 may include one of the air vent cap 22 and the suction cap 23, and the control means 31 may perform the control to reduce the pressure in each of the ink reservoir chambers 8B to 8C through one of the air vent cap 22 and the suction cap 23.

(ii) In stead of connecting the air vent cap 22 to the whole of the opening end on the atmospheric side of each of the air vent passages 9B to 9C, the air vent cap 22 or the suction cap 23 may independently be provided in each opening end on the atmospheric side of each of the air vent passages 9B to 9C.

The control means 31 may be configured to perform the control for removing the air to each of the air vent passages 9B to 9C.

(iii) The rod members 29B to 29C and the air vent cap 22 may separately be raised and lowered using the individual elevating devices.

(iv) In the above configuration (iii), a time length for the inks to return from the ink reservoir chambers 8B to 8C to the ink cartridges 6B to 6C through the ink supply tubes 7B to 7C may previously be measured. The control for raising the rod members 29B to 29C may be performed only for the measured time based on the timer signal from the timer 32. After the elapsed time measured by the timer, the rod members 29B to 29C may be lowered to close the air vent valves to perform the control for driving the suction pump.

(v) For the ink supply from the ink cartridges 6B to 6C to the ink tank 8, instead of reducing the pressure in ink reservoir chambers 8B to 8C to supply the inks, the positive pressure may be applied to the inks in the ink cartridges 6B to 6C to supply the ink.

Furthermore, according to another embodiment of the invention, the control means performs the control such that the operating member is driven to open the air vent valve means. Therefore, the atmospheric pressure affects the inside of the ink reservoir chamber in the ink tank, and the ink in the ink reservoir chamber and the ink in the ink supply channel return to the ink cartridge through the ink supply channel. This is because the ink cartridge is arranged below the ink tank. At this point, the air existing in the ink supply system including the ink reservoir chamber and the ink supply channel also returns to the ink cartridge. Then, under the control of the control means, the suction means is driven to fill the ink reservoir chamber with the ink from the ink cartridge through the ink supply channel. Therefore, the air existing in the ink supply system can be removed only by the small amount of ink discharge.

Particularly, the structure of the inkjet recording apparatus does not become complicated because the above removal operation is performed using the air vent valve means or suction means which is already included in the inkjet recording apparatus.

According to another embodiment, the air vent cap is configured to be able to be separated from and brought into contact with the opening end on the atmospheric side of the air vent passage, so that the pressure in the ink reservoir chamber can easily be reduced from the air vent passage through the air vent cap. Therefore, the ink can easily be supplied from the ink cartridge to the ink reservoir chamber.

According to another embodiment, the control in which the control means drives the operating member to open the air vent valve means and the control in which the control means drives the suction means to reduce the pressure in the ink reservoir chamber are performed at the substantially same time. Therefore, only the air separated from the ink in the ink reservoir chamber can be exhausted without returning the ink in the ink reservoir chamber to the ink cartridge.

According to another embodiment, the suction cap is configured to be able to be separated from and brought into contact with the ink discharge nozzle of the inkjet head, so that the pressure in the ink reservoir chamber can easily be reduced from the ink discharge nozzle through the suction cap. Therefore, the ink can easily be supplied from the ink cartridge to the ink reservoir chamber.

According to another embodiment, the pressure in the ink reservoir chamber is reduced through one of the air vent cap and suction cap which are included in the inkjet recording apparatus, so that the ink can easily be supplied from the ink cartridge to the ink reservoir chamber.

According to another embodiment, the switch valve switches the communication state with the air vent cap of the suction pump and the communication state with the suction cap of the suction pump, so that the pressure in the ink reservoir chamber can be reduced through one of the air vent cap and the suction cap. Therefore, the ink can easily be supplied from the ink cartridge to the ink reservoir chamber.

According to another embodiment, the ink chamber and the communicating path are provided in the ink tank for each ink, so that the control means can perform the control on each communicating path. Therefore, the air removal operation can be performed for each ink reservoir chamber.

According to the above disclosure, the air vent valve means is opened such that the ink in the ink reservoir chamber returns to the ink cartridge through the ink supply channel. Therefore, not only the ink in the ink reservoir chamber but also the air existing in the ink supply system can be returned to the ink cartridge. Then, the pressure in the ink reservoir chamber is reduced. This enables the ink reservoir chamber to be filled with the ink from the ink cartridge through the ink supply channel. Through the above operations, the air existing in the ink supply system can be removed only with the small amount of ink discharge.

As this description may be embodied in several forms without departing from the spirit of essential characteristics thereof, the present embodiments are therefore illustrative and not restrictive, since the scope is defined by the appended claims rather than by description preceding them, and all changes that fall within metes and bounds of the claims, or equivalence of such metes and bounds thereof are therefore intended to be embraced by the claims.

What is claimed is:

1. An inkjet recording apparatus comprising:

an inkjet head for discharging ink to a recording medium;

a head holder which is relatively movable with respect to the recording medium and holds the inkjet head;

an ink tank which is mounted on the head holder for supplying the ink to the inkjet head, the ink tank having:

an ink chamber for reserving the ink;

a communicating path for communicating the ink chamber with atmosphere; and an exit valve to open and close the communicating path with respect to the atmosphere;

an ink cartridge arranged below the ink tank for supplying the ink to the ink chamber through an ink supply channel;

an operating member for opening and closing the exit valve by moving;

a transfer device for transferring the ink from the ink cartridge to the ink chamber by applying a pressure to the ink; and a controller for performing controls of:

moving the operating member to open the exit valve so that an atmosphere pressure affects an inside of the ink chamber and so that the ink in the ink chamber and the ink in the ink supply channel return to the ink cartridge through the ink supply channel; and then applying the pressure to the ink to fill the ink chamber with the ink from the ink cartridge through the ink supply channel.

2. The inkjet recording apparatus according to claim 1, further including:

a timer for counting an elapsed time from a point of time when the controller performs the control for moving the operating member to open the exit valve, wherein the controller detects elapse of a predetermined period by the timer counting the elapsed time which equals to the predetermined time, and, after the detection of the elapse, performs the control for driving the transfer device to fill the ink chamber with the ink from the ink cartridge through the ink supply channel.

3. The inkjet recording apparatus according to claim 1:

wherein an absolute value of the pressure applied to the ink is larger than an absolute value of a pressure due to difference in elevation between a position of the ink tank and a position of the ink cartridge.

4. The inkjet recording apparatus according to claim 1:

wherein the pressure applied to the ink is a negative pressure.

5. The inkjet recording apparatus according to claim 1, further comprising:

an actuator which is provided with the operating member and drives the operating member under the control of the controller.

6. The inkjet recording apparatus according to claim 1:

wherein the transfer device includes:

an air vent cap detachably connected to an opening end on an atmospheric side of the communicating path; and an evacuation unit for evacuating the ink chamber through the air vent cap and the communicating path; and wherein the controller performs controls of driving the transfer device to:

connect the air vent cap to the opening end on the atmospheric side of the communicating path;

evacuate the ink chamber through the air vent cap and the communicating path; and transfer the ink from the ink cartridge to the ink chamber.

7. The inkjet recording apparatus according to claim 1:

wherein the transfer device includes:

a suction cap detachably connected to an ink discharge nozzle of the inkjet head; and an evacuation unit for evacuating the ink chamber through the suction cap; and wherein the controller performs controls of driving the transfer device to connect the suction cap to the ink discharge nozzle of the inkjet head;

evacuate the ink chamber through the suction cap and the ink discharge nozzle; and transfer the ink from the ink cartridge to the ink chamber.

8. The inkjet recording apparatus according to claim 1, further comprising:

an air vent cap detachably connected to an opening end on an atmospheric side of the communicating path; and a suction cap provided near the air vent cap and detachably connected to an ink discharge nozzle of the inkjet head;

wherein the opening end on the atmospheric side of the communicating path and the ink discharge nozzle of the inkjet head are arranged close to each other;

wherein the transfer device includes:

an evacuation unit for evacuating the ink chamber through one of the air vent cap and the suction cap; and wherein the controller performs controls of driving the evacuation unit to:

evacuate the ink chamber through one of the air vent cap and the suction cap; and transfer the ink from the ink cartridge to the ink chamber.

9. The inkjet recording apparatus according to claim 1;

wherein the inkjet head has a group of nozzles for discharging a plurality of colors of inks, the ink tank is provided with the ink chamber and the communicating path for each ink, and the controller performs each set of controls corresponding to each ink.

10. The inkjet recording apparatus according to claim 6:

wherein the controller substantially simultaneously performs controls of:

moving the operating member to open the exit valve; and driving the evacuation unit to evacuate the ink chamber so that air separated from the ink is exhausted from the ink chamber and so that the ink in the ink chamber is not restored to the ink cartridge.

11. The inkjet recording apparatus according to claim 6:

wherein the transfer device includes an actuator for connecting the air vent cap to the opening end on the atmospheric side of the communicating path under the control of the controller.

12. The inkjet recording apparatus according to claim 7:

wherein the transfer device includes an actuator for connecting the suction cap to the ink discharge nozzle of the inkjet head under the control of the controller.

13. The inkjet recording apparatus according to claim 8:

wherein the transfer device further includes:

a suction pump for sucking the ink chamber through one of the air vent cap and the suction cap;

a suction passage for communicating both the air vent cap and the suction cap with the suction pump; and a switch valve provided in a midpoint of the suction passage for switching between a state of communication of the suction pump with the air vent cap and a state of communication of the suction pump with the suction cap.

14. A method of removing air for an inkjet recording apparatus, the inkjet recording apparatus including:

an inkjet head for discharging ink to a recording medium;

a head holder which is relatively movable with respect to the recording medium and holds the inkjet head;

an ink tank which is mounted on the head holder for supplying the ink to the inkjet head, the ink tank having an ink chamber for reserving the ink;

a communicating path for communicating the ink chamber with atmosphere; and an exit valve to open and close the communicating path with respect to the atmosphere; and an ink cartridge arranged below the ink tank, for supplying the ink to the ink chamber through an ink supply channel, and the method comprising:

opening the exit valve so that an atmospheric pressure affects an inside of the ink chamber and so that the ink in the ink chamber and the ink in the ink supply channel return to the ink cartridge through the ink supply channel; and then applying the pressure to the ink to fill the ink chamber with the ink from the ink cartridge through the ink supply channel.

* * * * *